United States Patent [19]

Ward et al.

[11] 4,382,855

[45] May 10, 1983

[54] PROCESS FOR REMOVAL OF HYDROXY- AND/OR MERCAPTO-SUBSTITUTED HYDROCARBONS FROM COAL LIQUIDS

[75] Inventors: Clifford Ward, Louisa; Charles A. Johnson, III, Ashland, both of Ky.

[73] Assignee: Ashland Oil, Inc., Ashland, Ky.

[21] Appl. No.: 315,823

[22] Filed: Oct. 28, 1981

[51] Int. Cl.[3] ..... C10G 29/20; C10G 17/00

[52] U.S. Cl. ..... 208/236; 208/263

[58] Field of Search ..... 208/236, 263

[56] References Cited

U.S. PATENT DOCUMENTS

| | | | |
|---|---|---|---|
| 2,152,720 | 4/1939 | Yabroff | 208/263 |
| 2,311,342 | 2/1943 | Kerns et al. | 208/236 |
| 2,383,416 | 8/1945 | Reed | 208/236 |
| 2,497,954 | 2/1950 | McCulley | 208/236 |
| 2,797,188 | 6/1957 | Taylor et al. | 208/263 |
| 2,971,906 | 2/1961 | Webster | 208/254 |
| 3,126,331 | 3/1964 | Landis et al. | 208/240 |
| 3,282,830 | 11/1966 | Boyum et al. | 208/323 |
| 3,291,728 | 12/1966 | Boyum et al. | 208/321 |
| 3,719,587 | 3/1973 | Karchmer et al. | 208/208 |
| 3,847,800 | 11/1974 | Guth et al. | 208/236 |

OTHER PUBLICATIONS

Suurpere et al., A Study of the Separation of Phenols from Shale Oil by Means of Ethanolamine Water Solutions, Tr. Tallin. Politekh. Inot, Ser. A (270) 105–111, 1969.

Chemical Abstracts, vol. 58, Item 10788f.

*Primary Examiner*—Delbert E. Gantz
*Assistant Examiner*—Helane E. Maull
*Attorney, Agent, or Firm*—Richard C. Willson, Jr.; Charles A. McCrae

[57] ABSTRACT

Removal of hydroxy-substituted and/or mercapto-substituted-hydrocarbons from coal liquids which comprises contacting the coal liquids with an aqueous composition containing an alkanolamine, thereby providing a two-phase mixture, and then separating the mixture into an aqueous extract phase and a naphtha rich raffinate phase.

19 Claims, 2 Drawing Figures

PROCESS FOR REMOVAL OF HYDROXY- AND/OR MERCAPTO-SUBSTITUTED HYDROCARBONS FROM COAL LIQUIDS

DESCRIPTION

1. Technical Field

The present invention is concerned with separating hydroxy-, and/or mercapto-substituted hydrocarbons from admixture with coal liquids. In particular, the present invention is concerned with separating phenolic compounds, and/or mercaptans which are in admixture with coal liquids boiling below about 400° F. The treated coal liquids, according to the present invention, can then be processed to form desirable combustible fuels, such as gasoline. In addition, the impurities removed from the coal liquids, such as phenolic compounds, can be obtained for subsequent use.

2. Background Art

In view of the substantial price increases in petroleum oils in the last years, along with the continuing increased demands for energy, renewed attention has been focused on the recovery of oil from sources other than petroleum, such as from coal, and the subsequent conversion of the oil to usable, valuable, combustible products.

A number of differences exist between petroleum oils and oils derived from coal. One significant difference is the presence of large amounts of impurities such as hydroxy-substituted hydrocarbons including phenolic compounds present in coal liquids. For instance, coal liquid naphthas generally contain at least about 3.5% and mostly at least about 10% by weight of phenolic compounds. These quantities of phenolic compounds, if not significantly reduced prior to such processes as catalytic cracking, can significantly affect the process in an adverse manner. The phenolic compounds tend to poison and/or reduce the catalyst activity of the catalyst employed in such processes.

Not only is the presence of such large amounts of phenolic compounds harmful to processing of the coal liquids, but not being able to obtain significant amounts of such is undesirable, since the phenolic compounds per se can be valuable commercial products.

DISCLOSURE OF INVENTION

The present invention is concerned with a process for separating hydroxy-substituted hydrocarbons and/or thio-substituted hydrocarbons from admixture with coal liquids. The coal liquids treated according to the process of the present invention boil below about 400° F.

The process includes contacting the admixture with an aqueous composition of a water-miscible alkanolamine. The aqueous composition contains at least about 40% by weight of the alkanolamine. This contact results in the formation of a two-phase mixture.

The two-phase mixture is then separated into an aqueous extract phase and a naphtha-raffinate phase. The aqueous extract phase is admixed with additional water in order to increase the water content to about 70 to about 85% by weight. This results in the formation of a second naphtha phase and a second aqueous extract phase. The second naphtha phase and second aqueous extract phase are then separated from each other.

The second aqueous extract phase is then treated in order to regenerate the aqueous alkanolamine and obtain the hydroxy-substituted hydrocarbons, and/or the thio-substituted hydrocarbons removed from the liquid coal naphtha.

DESCRIPTION OF BEST AND VARIOUS MODES FOR CARRYING OUT INVENTION

Figure 1:
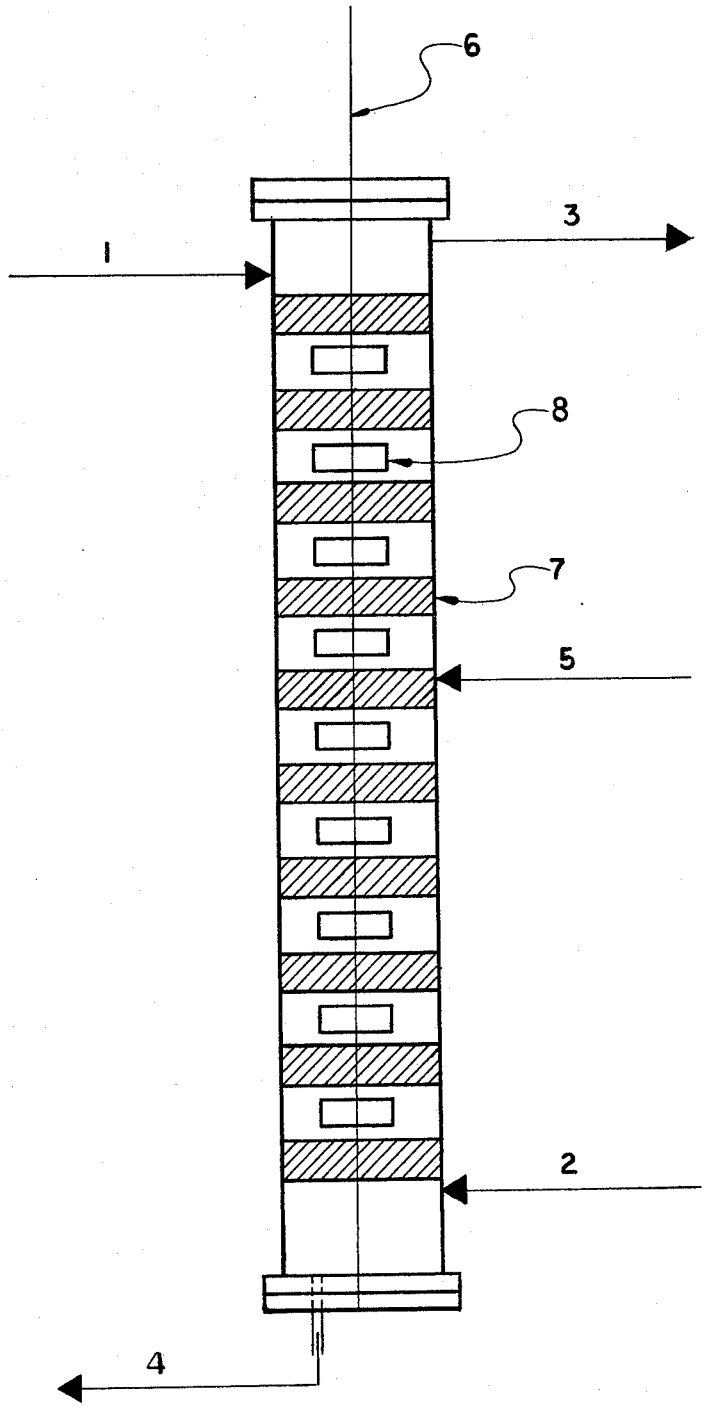
FIG. 1 is a flow diagram of a sequence of steps for carrying out the process of the present invention.

The coal liquids treated according to the present invention boil below about 400° F., and preferably about 80° to about 400° F. The coal liquids usually contain hydroxy-substituted hydrocarbons in amounts of at least about 3.5%, and mostly about 7.5% to about 10.0% by weight of the coal liquid. Moreover, such generally contains at least about 0.01%, and mostly at least about 0.25% by weight of thio-substituted hydrocarbon compounds, such as thiophenol. The predominant hydroxy-substituted hydrocarbons present in the coal liquids treated according to the present invention are hydroxy-substituted aromatic hydrocarbons and especially mononuclear phenolic compounds, such as phenol and alkyl-substituted phenols, such as orthocresol, metacresol, paracresol, and the xylenols, such as 3,4-xylenol, 3,5-xylenol, 2,4-xylenol, 2,6-xylenol, 2,3-xylenol, and 2,5-xylenol. Also, the coal liquids treated according to the present invention can contain substantial amounts of carboxylic acids which are concomitantly removed along with the hydroxy- and/or thio-substituted hydrocarbons.

The coal extract, from which the coal liquid naphthas treated according to the present invention are obtained, can be produced by a number of well-known liquifying methods, such as the extraction of coal by hydrogen-donor solvents, SRC deashing process, and the catalytic hydrogenation of coal in a liquid solvent. Preferably, the coal liquid naphthas treated according to the present invention are obtained by the direct catalytic hydroliquidification process generally referred to as "H-Coal." H-Coal is a direct catalytic hydroliquidification process developed by Hydrocarbon Research, Inc. The H-Coal process generally involves initially crushing, drying and slurring the coal with a process-derived oil and pumping such at the reactor pressure, wherein it is mixed with hydrogen and fed to the reactor. In the reactor, the coal, recycled oil and hydrogen react in the presence of a catalyst. The catalyst employed is in the form of an ebullating bed. The reactor typically operates at a temperature of about 450° C. and a pressure of about 3000 psig.

One particular hydrogen donor solvent involves contacting the coal with a hydrogen-donor solvent at a temperature of about 700° F. to about 850° F. and a pressure of about 350 psig to about 1000 psig, either in the presence of or in the absence of extraneously added molecular hydrogen. An extraction period of from about 1 hour to about 2 hours is usually employed. The product in the extraction zone includes a liquid extract phase and a solid undissolved residue. The extract may be first flushed to remove naphtha and lighter materials or may be charged directly to a hydrocracking zone. In either event, the higher constituents are hydrocracked to produce naphtha which can be separately treated according to the present invention or which can be combined with the flash naphtha before such treatment.

Suitable hydrocracking conditions include contact with a cobalt-molybdenate catalyst and hydrogen at a temperature of about 750° F. and a pressure of about 2000 psig, a weight hourly space velocity of about 0.8 pound of liquid per pound of catalyst per hour, and a hydrogen feed rate of about 50,000 SCF/B.

A typical H-Coal naphtha treated according to the present invention has the following characteristics:

| FIA (Flourescent Indicator Absorption) Analysis | | |
|---|---|---|
| P + N (paraffins + naphthenes) | - | 72.7 |
| O (olefins) | - | 6.2 |
| A (aromatic) | | 21.1 |
| PONA | | |
| P - 19.2 | | |
| N - 53.5 | | |
| O - 6.2 | | |
| A - 21.1 | | |

The liquid coal naphtha is contacted with an aqueous composition of a water-miscible alkanolamine. The aqueous composition contains at least about 40% by weight, and preferably about 50% to about 60% by weight of the alkanolamine. The alkanolamine can be a primary, secondary of tertiary amine and is preferably a monoamine. Each of the alkanol groups of the amine preferably contain a maximum of four carbon atoms and a single hydroxyl group. Examples of some alkanolamines are monoethanolamine, diethanolamine, triethanolamine, monoisopropanolamine, triisopropanolamine and diisopropanolamine. The preferred amines are monoethanolamine and monopropanolamine. Mixtures of amines can be employed.

The amount of alkanolamine employed is generally at least about 0.01 to about 2.0 parts per part of liquid coal naphtha, and preferably about 1 part per ten parts by volume of liquid coal naphtha. The aqueous alkanolamine is preferably contacted with the liquid coal naphthas by countercurrent flow. An example of a suitable contact apparatus is a York-Scheibel Column (see FIG. 2) whereby the aqueous alkanolamine is introduced via conduit 1, the liquid coal naphtha is introduced via conduit 2, the coal naphtha raffinate is removed via conduit 3, and the aqueous alkanolamine phenol extract is removed via conduit 4. Coal liquids can be recycled to the treatment if desired via conduit 5. The column contains stirring means 6 to facilitate contact and contact means 7. The contact means 7 can be stainless steel wire mesh. Of course, it is understood that other means of contact between the aqueous alkanolamine and liquid coal naphthas can be employed.

The particular York-Scheibel Column shown is about 40 inches long and about one inch inside diameter. As noted from FIG. 2, the column contains nine mixing stages 8, and ten stainless steel coalescing stages 7. The stirrer can typically be operated at about 250 RPM.

The naphtha raffinate phase can then be subjected to further processing in order to produce combustible fluids, such as gasoline. The aqueous extract phase includes the hydroxy-substituted hydrocarbons, and/or mercapto-substituted hydro-carbons, and carboxylic acids initially present in the liquid coal naphthas. Such impurities are in the form of salts with the alkanolamine employed. The aqueous extract phase also includes some liquid coal naphthas.

In order to recover the liquid coal naphthas contained in the aqueous extract phase, the aqueous extract phase is admixed with additional water. The water content of the aqueous extract phase is increased to about 70 to about 85% by weight and preferably about 75% by weight. This results in the formation of a second coal liquid naphtha phase and a second aqueous extract phase. The second liquid coal naphtha phase is then separated from the second aqueous phase by conventional methods, such as decantation. Once separated, the second naphtha phase can then be subjected to known conventional processing to produce combustible fuels, such as gasoline.

After this, the second aqueous extract phase is treated to thereby regenerate the aqueous alkanolamine composition and to obtain a phase containing the separated hydroxy-substituted hydrocarbons and/or mercapto-substituted hydrocarbons and carboxylic acids if present, from the initial liquid coal naphthas.

The preferred method for the separation is to contact the second aqueous phase with an acidic gas, such as $CO_2$ or $H_2S$. The amount of acidic gas employed is such as to reduce the pH of the aqueous composition to about 8 or less. The pressure employed is about 5 to about 15 psig. By the above procedure, at least about 90% of the hydroxy-substituted hydrocarbon and/or mercapto-substituted hydrocarbon impurities in the liquid coal naphthas are removed.

The hydroxy-substituted hydrocarbons and/or mercapto-substituted hydrocarbons if desired, can be separated into individualized products. For instance, in the case of the impurities being phenolic material, such as phenol, orthocresol, metacresol, paracresol, and the xylenols, the mixture can be distilled into phenol, orthocresol, and a mixture of meta- and paracresol. The mixture of meta- and paracresol can then be subjected to crystallization in order to provide high purity paracresol. Paracresol at the present is the most important cresol from a commercial standpoint and is useful in disinfectants, dyestuffs, dyes, synthetic polymers, pharmaceuticals, and pigments. Metacresol can be used in the preparation of synthetic resins, as developers in photography, for ore flotation, and for various xylenols which, if desired, can be employed as solvents, pharmaceuticals, insecticides, fungicides, lubricants, gasoline, and as peptizing agents for synthetic rubbers.

FIG. 1 is a flow diagram of a sequence of steps for carrying out the process of the present invention. In particular, the alkanolamine/water composition and liquid coal naphthas are introduced into extracter 23 via conduits 21 and 22, respectively. Treated coal naphtha is removed from extracter 23 via conduit 24 and can be conveyed for example to treating processes represented by 25 for conversion to gasoline which is removed via conduit 26. An aqueous portion containing the alkanolamine and hydroxy and/or mercapto hydrocarbons is removed from extrator 23 via conduit 27. Additional water is added to this aqueous portion via conduit 31. An oil phase is then separated from an aqueous phase via conduit 36.

The aqueous alkanolamine composition can then be regenerated and separated from the hydroxy and/or mercapto-substituted hydrocarbons such as by contacting the aqueous composition in vessel 29 with an acidic gas such as $CO_2$ or $H_2S$ or $SO_2$ introduced via conduit 28. The impurities from the naphtha (e.g., the hydroxy and/or mercapto substituted hydrocarbons) are removed via conduit 37.

The aqueous alkanolamine and acidic gas mixture can be conveyed to a stripper column 32 via conduit 30 wherein the aqueous alkanolamine composition is removed via conduit 33 and the acidic gas is removed via conduit 34. The aqueous alkanolamine 33 can be recycled and conveyed to conduit 21. The acidic gas can be recycled and conveyed to conduit 28. A bottoms is removed from column 32 via conduit 35.

The following nonlimiting examples are presented to further illustrate the present invention.

Figure 2:
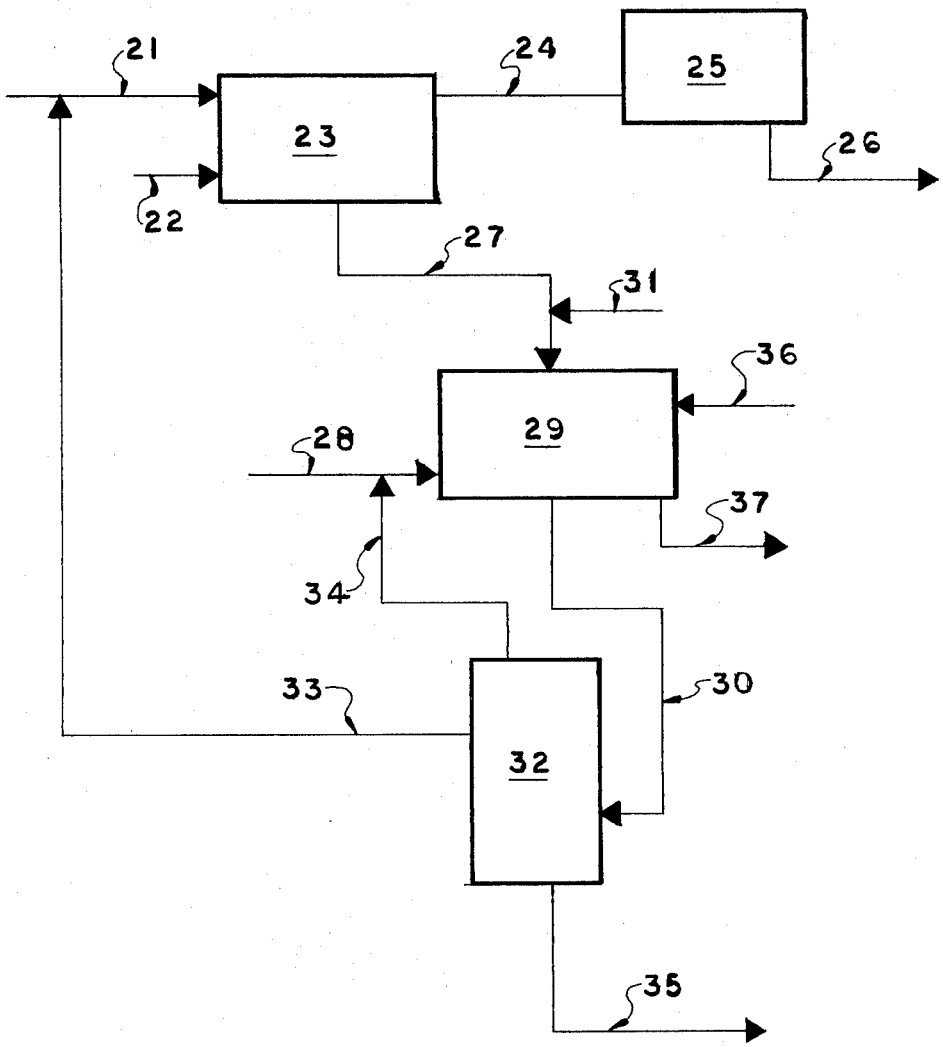
FIG. 2 is a schematic of apparatus useful in carrying out the extraction stage of the present invention.

About 17,230 ml of liquid coal naphtha are charged to the bottom portion of a York-Scheibel Column of the type illustrated in FIG. 2 via conduit 2. The feed rate of the liquid coal naphtha is about 48.9 ml per minute. About 2,770 ml of a 50% by volume aqueous monoethanolamine solution is introduced into the column via conduit 1 at the upper part of the column. The flow rate of the aqueous monoethanolamine composition is about 7.9 ml per minute. The column is operated at a temperature of about 75° F. and a stirrer rate of about 275 rpms. The ratio of the liquid coal naphthas to the monoethanolamine is about 12.4:1. The time of operation is about 352.4 minutes. About 4,000 ml of an aqueous layer containing the monoethanolamine and phenolic contaminants is withdrawn from the bottom of the column via conduit 4. About 16,000 ml of raffinate of liquid coal naphtha are removed from the top of the column via conduit 3. The extraction column employed is about 48 inches long with about a one inch inside diameter. The column is made up of about nine mixing stages and 10 stainless steel coalescing stages.

The liquid coal naphthas employed as feed have the following properties:

| | | | | |
|---|---|---|---|---|
| Gr. °API @ 60 | 39.7 | | | |
| Dist D-86 | | | | |
| IBP | 142 | | Gums mgs/100 ml | |
| 5 | 186 | | | |
| 10 | 200 | | Existent | 24.8 |
| 20 | 228 | | Potential | 257.0 |
| 30 | 244 | | | |
| 40 | 262 | | FIA in Vol. % | |
| 50 | 290 | | | |
| 60 | 320 | | Saturates | 67.1 |
| 70 | 326 | | Olefins | 6.5 |
| 80 | 344 | | Aromatics | 26.4 |
| 90 | 364 | | | |
| 95 | 382 | | Bromine No. | 31.6 |
| EP | 392 | | | |
| Rec | 98.0 | | Sulfur | 0.200 Wt. % |
| Res | 1.0 | | Nitrogen | 0.230 Wt. % |
| Loss | 1.0 | | Oxygen | 1.730 Wt. % |
| Phenols | 9.45 | Wt. % | | |
| | 9.00 | Vol. % | | |

The liquid coal raffinate has the following properties:

| | | | | |
|---|---|---|---|---|
| Gr. °API @ 60 | 44.4 | | | |
| Dist. D-86 | | | | |
| IBP | 156 | | Gums mgs/100 ml | |
| 5 | 190 | | | |
| 10 | 196 | | Existent | 15.0 |
| 20 | 220 | | Potential | 195.0 |
| 30 | 240 | | | |
| 40 | 258 | | FIA in Vol. % | |
| 50 | 270 | | | |
| 60 | 294 | | Saturates | 67.9 |
| 70 | 320 | | Olefins | 5.2 |
| 80 | 342 | | Aromatics | 26.9 |
| 90 | 364 | | | |
| 95 | 374 | | Bromine No. | 15.1 |
| EP | 388 | | | |
| Rec | 98.0 | | Sulfur | 0.210 |
| Res | 1.0 | | Nitrogen | 0.175 |
| Loss | 1.0 | | Oxygen | 0.198 |
| Phenols | 0.74 | Wt. % | | |
| | 0.70 | Vol. % | | |

The aqueous phase is contacted with additional water in order to increase the water concentration to about 75% by volume of the composition. This requires about 2770 ml of water. Upon admixing of the additional water, an oil phase and water phase develop. The oil phase is separated from the water phase and amounts to about 3.5% of the volume of the aqueous composition and consists of additional liquid coal naphthas.

The aqueous phase is then contacted with carbon dioxide gas until the pH is about 8. This results in a phenolic phase and an aqueous monoethanolamine phase which are readily separated.

As can be seen by the above values, about 91.7% of the initial phenolic compounds present is removed by the process. This is significantly greater than the amounts removed when the concentration of the initial monoethanolamine composition is reduced to about 25%, whereby only about 75% of the phenolic compounds are removed from the coal liquids. In addition, employing an initial concentration of about 25% by volume of monoethanolamine and a decreased ratio of liquid hydrocarbon to monoethanolamine of 5 to 1 only increases the removal to about 81.7% of the phenolic compounds.

EXAMPLE 2A

Coal liquid naphtha containing fractions boiling up to about 380° F. is contacted with a 50/50 weight percent monoethanolamine-water composition. The volume ratio of the hydrocarbon/monoethanolamine present in the aqueous composition is about 10:1. The extractions are carried out in separatory funnels and in three stages. The three stages are an effort to duplicate a continuous counter current extraction column. Table I below summarizes the volume extracted as the phenols mixture. This value is the difference between the weight of raffinate recovered and the weight of charge to the experiment after the extraction using three stages. Table II summarizes the isomer distribution of the phenols and the grams present and the grams of phenol extracted. The amount of phenols and isomer distribution are determined by G.C.

EXAMPLE 2B

Example 2A is repeated except that a 30/70 weight percent ratio monoethanolamine-water composition is employed. The results obtained are presented in Tables I–III hereinbelow.

EXAMPLE 2C

Example 2A is repeated except that a 70/30 weight percent ratio monoethanolamine-water composition is employed. The results obtained are presented in Tables I–III hereinbelow.

TABLE I

| Ex. No. | MEA/$H_2O$ Mixt. WT | Gms. Phenols Recov/Gmx. Chg | Phenols Recov. | MEA/$H_2O$ Final Conc.* | Neutral Oils Ext. in Mixt. Of MEA/$H_2O$ GMS. | MLS. |
|---|---|---|---|---|---|---|
| 2B | 30/70 | 11.0/243.0 | 4.53 | 15/85 | 0.9 | 1.1 |
| 2A | 50/50 | 19.0/403.0 | 4.71 | 25/75 | 1.1 | 1.3 |
| 2C | 70/30 | 28.0/568.0 | 4.93 | 35/65 | 1.4 | 1.7 |

*The final concentration of MEA/$H_2O$ is after dilution with water to spring out oils entrained in the mixture.

TABLE II

| Ex. No. | EXP MEA/$H_2O$ Mixt By WT | GMS Phenols Present | ISOMER DISTRIBUTION BY GRAMS Phenols Pres. | Phenols Ext. | Cresols Pres. | Cresols Ext. | Xylenols Pres. | Xylenols Ext. |
|---|---|---|---|---|---|---|---|---|
| 2B | 30/70 | 3.1221 | 0.8181 | 0.8163 | 1.1732 | 0.6170 | 1.1308 | 0.8266 |
| 2A | 50/50 | 3.1221 | 0.8181 | 0.7943 | 1.1732 | 0.9175 | 1.1308 | 1.0254 |
| 2C | 70/30 | 3.1221 | 0.8181 | 0.7842 | 1.1732 | 1.0654 | 1.1308 | 1.0841 |

Table III summarizes the results of the extractions or the extraction efficiency of the three different concentrations of the MEA/$H_2O$ mixtures on the respective isomers present.

TABLE III

| Ex. No. | EXP MEA/$H_2O$ Mixt By WT | Grams Phenols Present | WT % Of Phenols Extracted | WT % Of The Isomers Extracted as Phenol | Cresols | Xylenols |
|---|---|---|---|---|---|---|
| 2B | 30/70 | 3.1221 | 72.38 | 99.78 | 52.60 | 73.10 |
| 2A | 50/50 | 3.1221 | 87.67 | 97.09 | 78.20 | 90.68 |
| 2C | 70/30 | 3.1221 | 93.97 | 95.86 | 90.81 | 99.96 |

A review of the results shows that when using the 30/70 composition of Example 2B too much of the phenolic materials remain in the hydrocarbon raffinate, and that the 50/50 monoethanolamine composition of Example 2A removes about 21.1% more phenolic materials than the 30/70 composition. Both the 30/70 and 50/50 monoethanolamine/water compositions after dilution are easily regenerable. Although the use of the 70/30 monoethanolamine composition of Example 2C results in about a 7.2% increase removal of phenolics as compared to the use of the 50/50 composition, the regeneration of the 70/30 composition used greater amounts of water to dilute the acceptable concentrations in the processing schemes, and results in viscosity problems. The viscosity problems in turn can cause emulsion and corrosion problems. Therefore, although the 70/30 removes 93.97% of the phenols present, the economy of the increase in phenol removal is largely offset by the added processing cost and could very well result in greater over all cost.

What is claimed is:

1. A process for removing substituted hydrocarbons selected from the group of hydroxy substituted hydrocarbons, mercapto-substituted hydrocarbons, and mixtures thereof from admixture with liquid coal naphtha boiling below about 400° F. which comprises:

(a) contacting said admixture with an aqueous composition of a water-miscible alkanolamine containing at least about 40% by weight of said alkanolamine, thereby resulting in a two phase mixture;

(b) separating the two phase mixture into an aqueous extract phase and a naphtha raffinate phase;

(c) admixing the aqueous extract phase with additional water to increase the water content thereof to about 70 to about 85 weight % and thereby forming a second naphtha phase and second aqueous extract phase;

(d) separating the second naphtha phase and second aqueous extract phase from each other; and (e) separating the second aqueous extract phase into an aqueous-alkanolamine phase and a hydrocarbon phase containing said substituted hydrocarbons.

2. The process of claim 1 wherein said substituted hydrocarbon includes hydroxy substituted aromatic hydrocarbons.

3. The process of claim 1 wherein said substituted hydrocarbon includes mononuclear phenolic compounds.

4. The process of claim 1 wherein said substituted hydrocarbon includes phenol and cresols.

5. The process of claim 1 wherein said aqueous composition contains about 50 to about 60% by weight of said alkanolamine.

6. The process of claim 1 or 5 wherein said alkanolamine is a monoamine.

7. The process of claim 6 wherein each alkanol group of said alkanolamine contains up to 4 carbon atoms and has only one hydroxyl group.

8. The process of claim 1 or 5 wherein said alkanolamine is selected from the group of monoethanolamine, monopropanolamine or mixtures thereof.

9. The process of claim 1 wherein the aqueous extract phase in step (c) is admixed with additional water to increase the water content thereof to about 75% of weight.

10. The process of claim 1 wherein said second aqueous extract phase is contacted with an acidic gas thereby forming a two phase mixture; and then separating the two phase mixture from step (e) into an aqueous—alkanolamine phase and a hydroxy substituted aromatic hydrocarbon phase.

11. The process of claim 10 wherein said acidic gas is $CO_2$ or $H_2S$ or both.

12. The process of claim 1 wherein the ratio of said admixture to said alkanolamine is about 10:1.

13. The process of claim 4 wherein said phenol and cresols are separated and substantially pure cresols are obtained.

14. The process of claim 11 wherein the amount of acidic gas is sufficient to reduce the pH of the aqueous composition to 8 or less.

15. The process of claim 1 wherein said liquid coal naphtha contains at least about 3.5% phenolic compounds.

16. The process of claim 1 wherein said liquid coal naphtha contains at least about 10% by weight of phenolic compounds.

17. The process of claim 1 wherein said liquid coal naphtha contains about 7.5% to 10% by weight of phenolic compounds.

18. The process of claim 1 wherein said liquid coal naphtha contains at least about 0.01% of thio substituted hydrocarbon.

19. The process of claim 1 wherein said liquid coal naphtha contains at least about 0.25% of thio substituted hydrocarbon.

* * * * *